US006634935B2

(12) United States Patent
Young et al.

(10) Patent No.: US 6,634,935 B2
(45) Date of Patent: Oct. 21, 2003

(54) SINGLE DRIVE SYSTEM FOR A BI-DIRECTIONAL LINEAR CHEMICAL MECHANICAL POLISHING APPARATUS

(75) Inventors: Douglas W. Young, Sunnyvale, CA (US); Mark Henderson, Newark, CA (US); Bernard M. Frey, Berkeley, CA (US)

(73) Assignee: Nutool, Inc., Milpitas, CA (US)

( * ) Notice: Subject to any disclaimer, the term of this patent is extended or adjusted under 35 U.S.C. 154(b) by 15 days.

(21) Appl. No.: 10/126,469

(22) Filed: Apr. 18, 2002

(65) Prior Publication Data

US 2003/0022607 A1 Jan. 30, 2003

Related U.S. Application Data

(63) Continuation of application No. 09/880,730, filed on Jun. 12, 2001, now Pat. No. 6,464,571, which is a continuation-in-part of application No. 09/684,059, filed on Oct. 6, 2000, now Pat. No. 6,468,139, which is a continuation-in-part of application No. 09/576,064, filed on May 22, 2000, now Pat. No. 6,207,572, which is a continuation of application No. 09/201,928, filed on Dec. 1, 1998, now Pat. No. 6,103,628.

(51) Int. Cl.[7] ..... B24B 21/04

(52) U.S. Cl. ..... 451/168; 451/11; 451/296; 451/312

(58) Field of Search ..... 451/11, 41, 168, 451/296–298, 302–306, 312, 162, 164, 170, 172

(56) References Cited

U.S. PATENT DOCUMENTS 6,068,542 A * 5/2000 Hosokai ..... 451/37
6,110,025 A * 8/2000 Williams et al. ..... 451/286
6,113,479 A * 9/2000 Sinclair et al. ..... 451/288
6,129,540 A * 10/2000 Hoopman et al. ..... 425/373
6,135,859 A * 10/2000 Tietz ..... 451/41
6,136,715 A * 10/2000 Shendon et al. ..... 438/692
6,179,690 B1 * 1/2001 Talieh ..... 451/41
6,179,709 B1 * 1/2001 Redeker et al. ..... 451/6
6,241,583 B1 * 6/2001 White ..... 451/41
6,302,767 B1 * 10/2001 Tietz ..... 451/41
6,312,319 B1 * 11/2001 Donohue et al. ..... 451/56
6,379,231 B1 * 4/2002 Birang et al. ..... 451/296
6,413,873 B1 * 7/2002 Li et al. ..... 438/711

* cited by examiner

*Primary Examiner*—Joseph J. Hail, III
*Assistant Examiner*—David B. Thomas
(74) *Attorney, Agent, or Firm*—Pillsbury Winthrop LLP

(57) ABSTRACT

Described is a method and apparatus for producing bi-directional linear polishing that uses a flexible pad. In one aspect, a horizontal drive assembly moves a horizontal slide member that is horizontally moveable over rails attached to a single casting. Openings within the casting exist for the inclusion of the supply spool, the receive spool and the pad path rollers. A drive assembly translates the rotational movement of a motor into the horizontal bi-directional linear movement of the horizontal slide member. With the polishing pad properly locked in position, preferably being attached between a supply spool and the receive spool, horizontal bi-directional linear movement of the horizontal slide member creates a corresponding horizontal bi-directional linear movement of a portion of the polishing pad. Thus, the portion of the polishing pad disposed within a polishing area of the chemical mechanical polishing apparatus can polish a top front surface of a wafer using the bi-directional linear movement of the portion of the polishing pad.

25 Claims, 4 Drawing Sheets

SINGLE DRIVE SYSTEM FOR A BI-DIRECTIONAL LINEAR CHEMICAL MECHANICAL POLISHING APPARATUS

This application is a continuation-in-part of and claims the benefit of priority under 35 USC 119/120 to the following:

Application Ser. No. 09/880,730 filed Jun. 12, 2001, now U.S. Pat. No. 6,464,571 entitled "Polishing Apparatus and Method With Belt Drive System Adapted to Extend the Lifetime of a Refreshing Polishing Belt Provided Therein", which is a continuation-in-part of:

Application Ser. No. 09/684,059 filed Oct. 6, 2000, now U.S. Pat. No. 6,468,139 entitled "Chemical Mechanical Polishing Apparatus and Method with Loadable Housing", which is a continuation-in-part of:

Application Ser. No. 09/576,064 filed May 22, 2000, Now U.S. Pat. No. 6,207,572 entitled "Reverse Linear Chemical Mechanical Polisher with Loadable Housing", which is a continuation of:

Application Ser. No. 09/201,928 filed Dec. 1, 1998, Now U.S. Pat. No. 6,103,628 entitled "Reverse Linear Polisher With Loadable Housing".

BACKGROUND OF THE INVENTION

1. Field of the Invention

The present invention relates to a single drive system for a bi-directional linear chemical mechanical polishing apparatus.

2. Description of the Related Art

U.S. Pat. No. 6,103,628, assigned to the assignee of the present invention, describes a reverse linear chemical mechanical polisher, also referred to as bi-directional linear chemical mechanical polisher, that operates to use a bi-directional linear motion to perform chemical mechanical polishing. In use, a rotating wafer carrier within a polishing region holds the wafer being polished.

U.S. patent application Ser. No. 09/684,059, filed Oct. 6, 2000, which is a continuation-in-part of U.S. Pat. No. 6,103,628, describes various features of a reverse linear chemical mechanical polisher, including incrementally moving the polishing pad that is disposed between supply and receive spools.

While the inventions described in the above patent and application are advantageous, further novel refinements to the drive system that creates the reverse linear (or bi-directional linear) motion have been developed, which are described herein.

SUMMARY OF THE INVENTION

The present invention offers many advantages, including the ability to efficiently produce reverse linear motion for a chemical mechanical polishing apparatus.

Another advantage of the present invention is to provide for the ability to efficiently produce bi-directional linear motion in a chemical mechanical polishing apparatus that also allows for the incremental movement of the polishing pad.

Another advantage of the present invention is the provision for a single casting that houses the polishing pad, including the supply spool, the receive spool, and pad path rollers.

The present invention provides the above advantages with a method and apparatus for producing bi-directional linear polishing that uses a flexible pad. In one aspect, a horizontal drive assembly moves a horizontal slide member that is horizontally moveable over rails attached to a single casting. Openings within the casting exist for the inclusion of the supply spool, the receive spool and the pad path rollers. A drive assembly translates the rotational movement of a motor into the horizontal bi-directional linear movement of the horizontal slide member. With the polishing pad properly locked in position, preferably being attached between the supply spool and the receive spool, horizontal bi-directional linear movement of the horizontal slide member creates a corresponding horizontal bi-directional linear movement of a portion of the polishing pad. Thus, the portion of the polishing pad disposed within a polishing area of the chemical mechanical polishing apparatus can polish a top front surface of a wafer using the bi-directional linear movement of the portion of the polishing pad.

BRIEF DESCRIPTION OF THE DRAWINGS

The above and other objectives, features, and advantages of the present invention are further described in the detailed description which follows, with reference to the drawings by way of non-limiting exemplary embodiments of the present invention, wherein like reference numerals represent similar parts of the present invention throughout several views and wherein.

DETAILED DESCRIPTION OF THE PREFERRED EMBODIMENT

Figure 1:
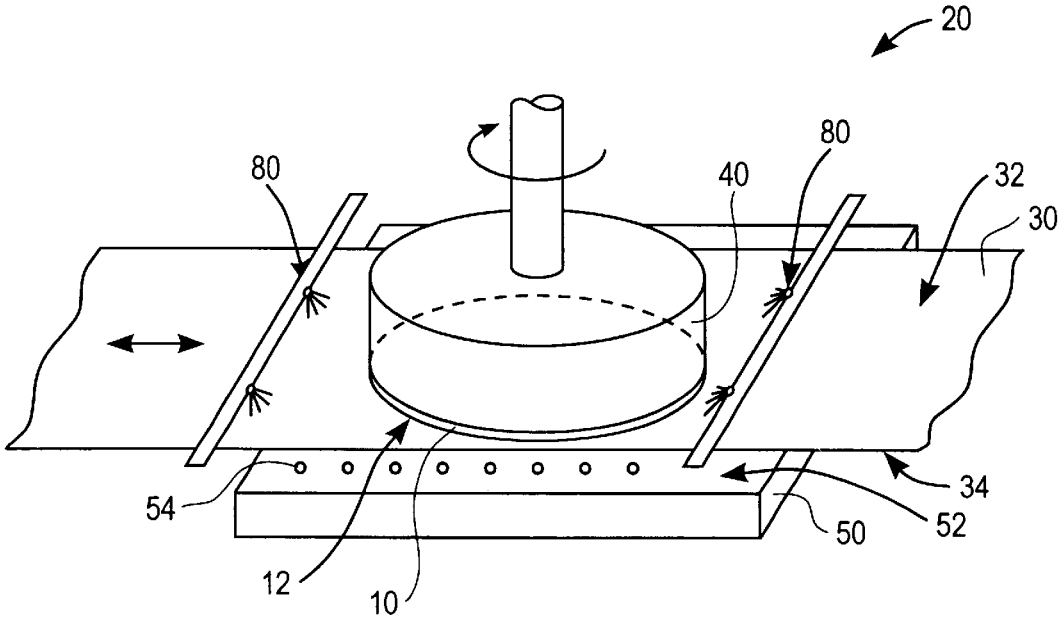
FIG. 1 illustrates a bi-directional linear polisher according to the present invention.

U.S. Pat. No. 6,103,628 and U.S. patent application Ser. No. 09/684,059, both of which are hereby expressly incorporated herein by reference, together describe, in one aspect, a reverse linear polisher that can use a polishing pad to polish a wafer. FIG. 1 illustrates a processing area 20 as described in the above references. A portion of the bi-directional linearly moving pad 30 for polishing a front wafer surface 12 of a wafer 10 within a processing area is driven by a drive mechanism. The wafer 10 is held in place by a wafer carrier 40 and can also rotate during a polishing operation as described herein.

Below the pad 30 is a platen support 50. During operation, due to a combination of tensioning of the pad 30 and the emission of a fluid, such as air, water, or a combination of different fluids from openings 54 disposed in the top surface 52 of the platen support 50, the bi-linearly moving portion of the pad 30 is supported above the platen support 50 in the processing area, such that a front side 32 of the pad 30 contacts the front surface 12 of the wafer 10, and the backside 34 of the pad 30 levitates over the top surface 52 of the platen support 50. While the portion of the pad 30 within the processing area moves in a bi-linear manner, the two ends of the pad 30 are preferably connected to source and target spools 60 and 62 illustrated in FIGS. 2 and 3, respectively, allowing for incremental portions of the pad 30 to be placed into and then taken out of the processing area, as described in U.S. patent application Ser. No. 09/684,059 referenced above, as well as further hereinafter.

Further, during operation, various polishing agents without abrasive particles or slurries with abrasive particles can be introduced, depending upon the type of pad 30 and the desired type of polishing, using nozzles 80. For example, the polishing pad 30 can contain abrasives embedded in the front side 32, and can be used with polishing agents but not a slurry being introduced, or with a polishing pad 30 that does not contain such embedded abrasives instead used with a slurry, or can use some other combination of pad, slurry and/or polishing agents. The polishing agent or slurry may include a chemical that oxidizes the material that is then mechanically removed from the wafer. A polishing agent or slurry that contains colloidal silica, fumed silica, alumina particles etc., is generally used with an abrasive or non-abrasive pad. As a result, high profiles on the wafer surface are removed until an extremely flat surface is achieved.

While the polishing pad can have differences in terms of whether it contains abrasives or not, any polishing pad 30 according to the present invention needs to be sufficiently flexible and light so that a variable fluid flow from various openings 54 on the platen support can affect the polishing profile at various locations on the wafer. Further, it is preferable that the pad 30 is made from a single body material, which may or may not have abrasives impregnated therein. By single body material is meant a single layer of material, or, if more than one layer is introduced, maintains flexibility such as obtained by a thin polymeric material as described herein. An example of a polishing pad that contains these characteristics is the fixed abrasive pad such as MWR66 marketed by 3M company that is 6.7 mils (0.0067 inches) thick and has a density of 1.18 g/cm$^3$. Such polishing pads are made of a flexible material, such as a polymer, that are typically within the range of only 4–15 mils thick. Therefore, fluid that is ejected from the openings 54 on the platen support 50 can vary by less than 1 psi and significantly impact the amount of polishing that will occur on the front face 12 of the wafer 10 that is being polished, as explained further hereinafter. With respect to the pad 30, the environment that the pad 30 is used in, such as whether a linear, bi-linear, or non-constant velocity environment will allow other pads to be used, although not necessarily with the same effectiveness. It has been determined, further, that pads having a construction that has a low weight per cm$^2$ of the pad, such as less than 0.5 g/cm$^2$, coupled with the type of flexibility that a polymeric pad achieves, also can be acceptable.

Another consideration with respect to the pad 30 is its width with respect to the diameter of the wafer 10 being polished, which width can substantially correspond to the width of the wafer 10, or be greater or less than the width of the wafer 10.

As will also be noted hereinafter, the pad 30 is preferably substantially optically transparent at some wavelength, so that a continuous pad 30, without any cut-out windows, can allow for detection of the removal of a material layer (end point detection) from the front surface 12 of the wafer 10 that is being polished, and the implementation of a feedback loop based upon the detected signals in order to ensure that the polishing that is performed results in a wafer 10 that has all of its various regions polished to the desired extent.

The platen support 50 is made of a hard and machineable material, such as titanium, stainless steel or hard polymeric material. The machineable material allows formation of the openings 54, as well as channels that allow the fluid to be transmitted through the platen support 50 to the openings 54. With the fluid that is ejected from the openings 54, the platen support 50 is capable of levitating the pad. In operation, the platen support 50 will provide for the ejection of a fluid medium, preferably air, but water or some other fluid can also be used. This ejected fluid will thus cause the bi-linearly moving pad 30 to levitate above the platen support 50 and pushed against the wafer surface when chemical mechanical polishing is being performed.

A pad drive system 100 that is preferably used to cause the bi-linear reciprocating movement of the portion of the polishing pad within the processing area will now be described.

Figure 3:
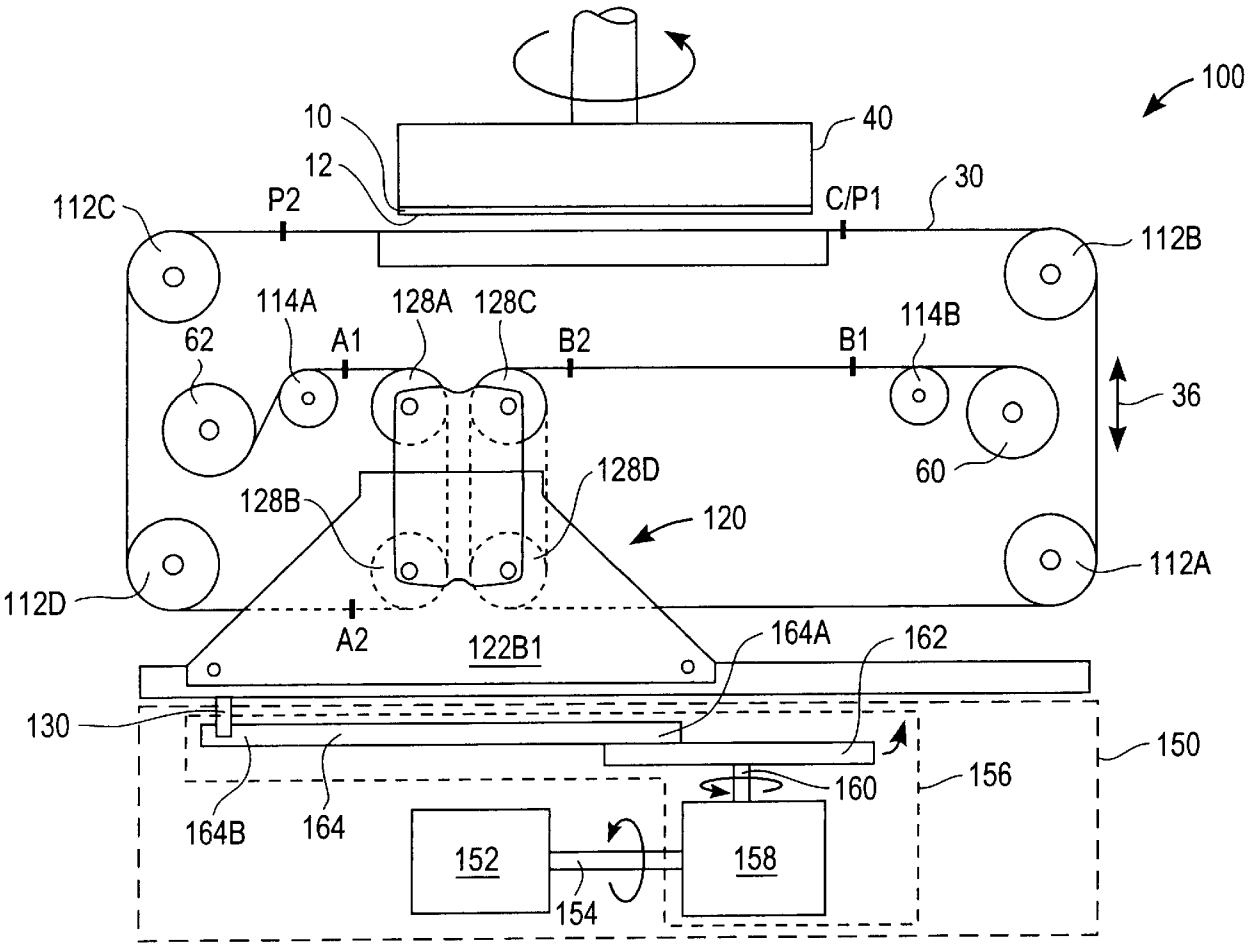
FIG. 3 illustrates a polishing pad path through components of the casting that provide for a processing area in which bi-directional linear motion of the polishing pad results.

As an initial overview, as illustrated by FIG. 3, a path 36 that the polishing pad 30 travels within the pad drive system 100 between the supply spool 60 and the receive spool 62 is illustrated. As shown, from the supply spool 60 and alignment roller 114B the path 36 includes passing through top 128C and then bottom 128D right slide rollers of the slide member 120, and then over each of rollers 112A, 112B, 112C and 112D in a rectangular shaped path and then around each of the bottom 128B and then top 128A left slide rollers of the slide member 120, and then to the alignment roller 114A and receive spool 62. As is apparent from FIG. 3, and with reference to the points A1, A2, B1, B2, and C, with the polishing pad 30 properly locked in position, preferably being attached between a supply spool 60 and the receive spool 62, horizontal bi-directional linear movement of the horizontal slide member 120 creates a corresponding horizontal bi-directional linear movement of a portion of the polishing pad. Specifically, for example, as the horizontal slide member 120 moves from right to left from position P1 to position P2, the point A1 on the pad 30 will remain in the same position relative to the receive spool 62, but the point A2 will have moved through the left side rollers 128A and 128B of the horizontal slide member 120. Similarly, the point B1 on the pad 30 will remain in the same position relative to the supply spool 60, and the point B2 will have moved through the right side rollers 128D and 128C of the horizontal slide member 120. As is apparent, by this movement, the point C will have moved linearly through the processing area. It is noted that the point C will move twice as far horizontally as compared to the horizontal movement of the horizontal slide member 120. Movement of the horizontal slide member 120 in the opposite direction will cause the point C of the polishing pad 30 to also move in the opposite direction. Thus, the portion of the polishing pad disposed within a polishing area (point C) of the chemical mechanical polishing apparatus can polish a top front surface of a wafer using the bi-directional linear movement of the portion of the polishing pad 30.

With the path 36 and the bi-linear pad movement mechanism having been described, a further description of the components within the path 36, and the horizontal movement drive assembly 150 associated therewith, will now be provided.

Figure 2:
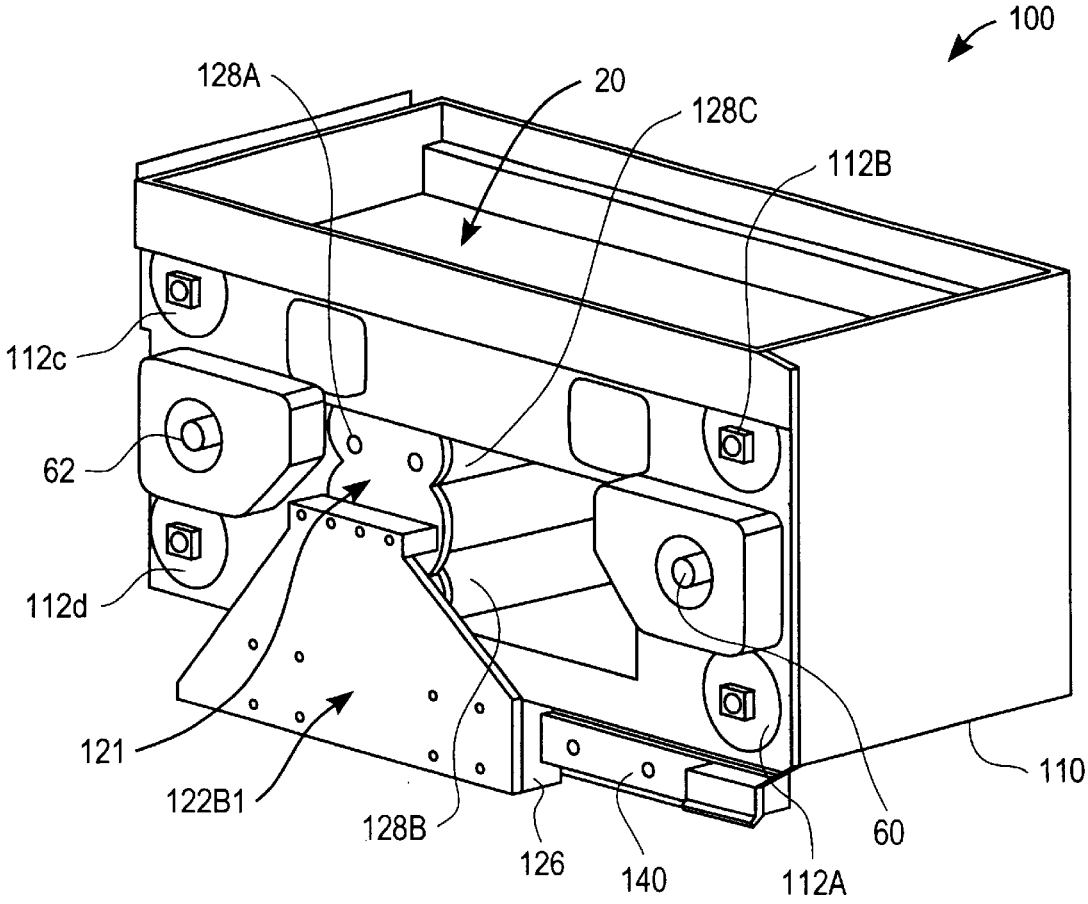
FIG. 2 illustrates a perspective view of a pad drive system that includes a horizontal slide member that is horizontally moveable over a stationary casting using drive components according to the present invention.
Figure 4:
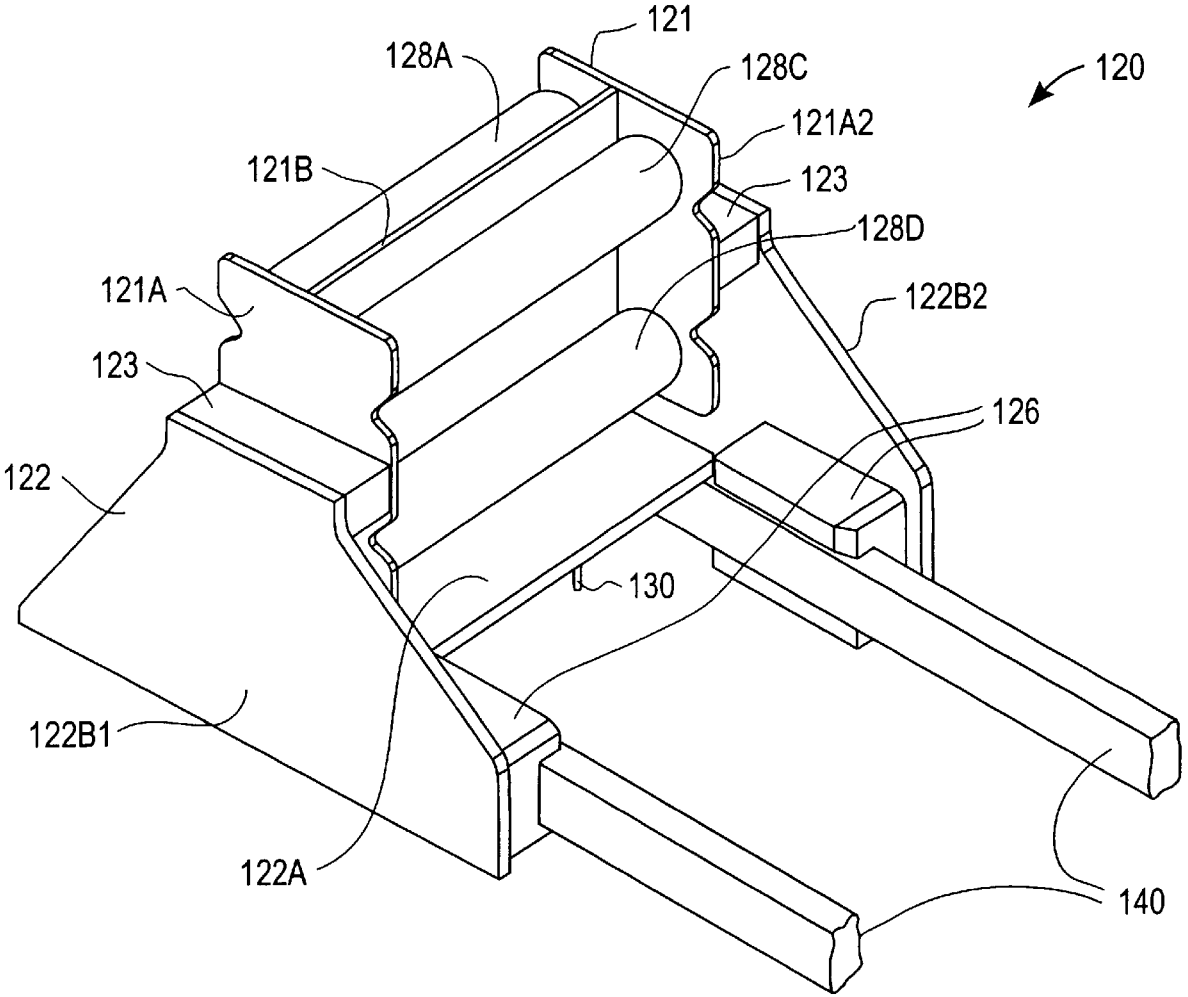
FIG. 4 illustrates a side view of a horizontal slide member and the drive system according to the present invention.

As illustrated in FIGS. 2 and 4, the horizontal slide member 120 is horizontally moveable over rails 140. The rails 140 are attached to a casting 110, made of a metal such as coated aluminum, which casting also has all of the other pad path generating components attached thereto as well. Thus, various openings within the casting 110 exist for the inclusion of these pad path components, including the supply spool 60 and the receive spool 62 (which are each attached to a spool pin associated therewith), as well as each of rollers 112A, 112B, 112C, 112D, 114A and 114B, as well as a large opening for a roller housing 121 and pin connection piece 122A that connect together the sidepieces 122B1 and 122B2 of the horizontal slide member 120. The rails 140, one on each side of the casting 110, provide a surface for mounting rails 140 on which the horizontal slide member 120 will move. As illustrated in FIG. 4, the horizontal slide member 120 is mounted on the rails 140 using carriage members 126. The carriage members 126 moveably hold the wafer in positions above and below the rail and can be used to reduce friction between the rails 140 and the horizontal slide member 120. The carriage members 126 may include sliding elements such as metal balls or cylinders (not shown) to facilitate sliding action of the horizontal sliding member 120.

With respect to the horizontal slide member 120, as illustrated in FIGS. 2 and 4, a support structure 122 is shaped with side-walls 122B1 and 122B2 with connecting piece 122A attached between them. The carrier members 126 are attached to the inner sides of the side-walls 122B1, 122B2. Further, the roller housing 121 is shaped with sidepieces 121A1 and 121A2, with a connecting piece 121B between them. The roller housing 121 is supported by the support structure 122. In this respect, side pieces 121A1 and 121A2 of the roller housing are attached to the side walls 122B1, 122B2 of the support structure 122, using support pieces 123. Attached between the two side pieces 121A1 and 121A2, in the vicinity of the connecting piece 121B, are four rollers 128A–D, with left side rollers 128A–B on one side of the connecting piece 121B and right side rollers 128C–D on the other side of the connecting piece 121B.

Furthermore, a pin 130 is downwardly disposed from the pin connection piece 122A as shown in FIG. 4, which pin 130 will connect to a link 164 associated with the horizontal drive assembly 150, described hereinafter. The horizontal drive assembly 150 will cause horizontal bid-directional linear movement of the pin 130, and therefore the horizontal bid-directional linear movement of entire horizontal slide member 120 along the rails 140.

The horizontal drive assembly 150, as shown in FIG. 3, is comprised of a motor 152 that will rotate shaft 154. Shaft 154 is connected to transmission assembly 156 that translates the rotational movement of the shaft 154 into the horizontal bi-directional linear movement of the horizontal slide member 120. In a preferred embodiment the transmission assembly 156 contains a gearbox 158 that translates the horizontal rotational movement of shaft 154 into a vertical rotational movement of shaft 160. Attached to shaft 160 is a crank 162 to which one end 164A of the link 164 is attached, with the other end 164B of the link 164 being attached to the pin 130, thereby allowing relative rotational movement of the pin 130 within the other end 164B of the link 164, which when occurring will also result in the horizontal bi-linear movement of the pin 130.

Thus, operation of the horizontal drive assembly 150 will result in the bi-directional linear movement of the horizontal slide member 120, and the corresponding horizontal bi-directional linear movement of a portion of the polishing pad 30 within the processing area.

As previously mentioned, during processing the polishing pad can be locked in position between the supply spool 60 and the receive spool 62. While a portion of the pad 30 within the processing area moves in the horizontal bi-directional linear manner, the pad can also be unlocked so that another portion of the polishing pad will move within the processing area, allowing incremental portions of the pad to be placed into and then taken out of the processing area, as describe in U.S. patent application Ser. No. 09/684,059 referenced above. Preferably to locking the portion of the polishing pad 30 in position during use, one end of the pad 30 can be locked and another end held in tension, as described in U.S. Application bearing attorney reference 042496/0293229 entitled "Pad Tensioning Method And System In A Bi-Directional Linear Polisher" filed on the same day as this application.

Although various preferred embodiments have been described in detail above, those skilled in the art will readily appreciate that many modifications of the exemplary embodiment are possible without materially departing from the novel teachings and advantages of this invention.

What is claimed is:

1. A method of creating a bi-directional linear movement of a portion of a polishing pad disposed within a processing area used for chemical mechanical polishing of a workpiece comprising the steps of:

creating rotational movement of a drive shaft;

translating the rotational movement on the drive shaft to a bi-directional linear movement of a slide member; and causing the bi-directional linear movement of the portion of the polishing pad within the processing area with the bi-directional linear movement of the slide member, the bi-directional linear movement of the portion of the polishing pad being used when chemically mechanically polishing the workpiece.

2. The method according to claim 1 wherein during the step of causing the polishing pad is disposed between a supply spool and a receive spool.

3. The method according to claim 2 wherein during the step of causing the polishing pad passes through rollers disposed on the slide member.

4. The method according to claim 2 wherein the step of translating provides horizontal bi-directional linear movement of the slide member, and the step of causing provides horizontal bi-directional linear movement of the portion of the polishing pad within the processing area.

5. The method according to claim 4 wherein the portion of the polishing pad moves horizontally at least two times as far as the slide member moves horizontally.

6. The method according to claim 2 wherein the portion of the polishing pad moves a greater amount than the slide member.

7. The method according to claim 2 wherein the step of causing includes providing a pad path on a plurality of rollers.

8. The method according to claim 7 wherein the pad path provides that only a back surface of the polishing pad will physically contact the plurality of rollers.

9. The method according to claim 1 wherein during the step of causing the polishing pad passes through rollers disposed on the slide member.

10. The method according to claim 1 wherein the step of translating provides horizontal bi-directional linear movement of the slide member, and the step of causing provides horizontal bi-directional linear movement of the portion of the polishing pad within the processing area.

11. The method according to claim 10 wherein the portion of the polishing pad moves horizontally at least two times as far as the slide member moves horizontally.

12. The method according to claim 1 wherein the portion of the polishing pad moves a greater amount than the slide member.

13. The method according to claim 1 wherein the step of causing includes providing a pad path on a plurality of rollers.

14. The method according to claim 13 wherein the pad path provides that only a back surface of the polishing pad will physically contact the plurality of rollers.

15. An apparatus for creating bi-directional linear motion within a predetermined area with a portion of a polishing pad corresponding to a processing area used for chemical mechanical polishing of a workpiece using a solution comprising:

a drive assembly that contains a rotatable shaft;

a slide member that is moveable within a slide area, the slide member being mechanically coupled to the drive assembly, such that rotation of the rotatable shaft creates bi-linear movement of the slide member; and wherein the polishing pad is disposed through the slide member, such that bi-linear movement of the slide member creates a corresponding bi-linear movement of the portion of the polishing pad, the bi-linear movement of the portion of the polishing pad being used when chemically mechanically polishing the workpiece.

16. The apparatus according to claim 15 wherein the drive assembly includes:

a gear box coupled to the rotatable shaft and which contains another rotatable shaft;

a crank coupled to the another rotatable shaft; and a link coupled between the link and the slide member.

17. The apparatus according to claim 16 wherein the slide member includes a plurality of rollers.

18. The apparatus according to claim 17 wherein the bi-linear movement of the slide member is horizontal.

19. The apparatus according to claim 18 wherein the bi-linear movement of the portion of the polishing pad in the processing area is horizontal.

20. The apparatus according to claim 19 further including a plurality of rollers that provides a pad path between a supply spool and a receive spool.

21. The apparatus according to claim 20 wherein the plurality of rollers are arranged such that the pad path provides that only a back surface of the polishing pad will physically contact the plurality of rollers.

22. A drive assembly for providing a path for horizontal linear movement of a portion of a polishing pad within a processing area, the polishing pad being disposed between a supply spool and a receive spool, the drive assembly comprising:

a driving device that contains a rotatable shaft;

a single casting of metal, the casting containing openings, the casting further including a horizontal slide area;

a supply pin, a receive pin, and a plurality of rollers disposed within the openings on the casting, the supply pin and the receive pin capable of having the supply spool and the receive spool respectively attached thereto with the polishing pad being disposed therebetween; and a horizontal slide member that is horizontally moveable within the horizontal slide area, the horizontal slide member being mechanically coupled to the driving device and capable of being coupled to the polishing pad, such that rotation of the rotatable shaft creates horizontal movement of the slide member and will create the horizontal linear movement of the polishing pad.

23. The apparatus according to claim 22 wherein the horizontal slide member moved in a bi-linear movement direction and is capable of causing horizontal bi-linear movement of the portion of the polishing pad.

24. The apparatus according to claim 23 wherein the driving device includes:

a gear box coupled to the rotatable shaft and which contains another rotatable shaft;

a crank coupled to the another rotatable shaft; and a link coupled between the link and the horizontal slide member.

25. The apparatus according to claim 23 further including a plurality of rails attached to the casting on which the horizontal slide member is horizontally moveable.

* * * * *